US005758790A

United States Patent [19]

Ewing, Jr.

[11] Patent Number: 5,758,790

[45] Date of Patent: Jun. 2, 1998

[54] BOTTLE-SHAPED CONTAINER

[75] Inventor: Paul E. Ewing, Jr., Monroe, Conn.

[73] Assignee: Mott's Inc., Stamford, Conn.

[21] Appl. No.: 565,416

[22] Filed: Nov. 30, 1995

Related U.S. Application Data

[63] Continuation of Ser. No. 338,272, Nov. 14, 1994, abandoned, which is a continuation of Ser. No. 116,327, Sep. 3, 1993, abandoned.

[51] Int. Cl.[6] ..... B65D 23/10

[52] U.S. Cl. ..... 215/384; 215/398

[58] Field of Search ..... 220/669, 675; 215/383, 384, 396, 398, 40

[56] References Cited

U.S. PATENT DOCUMENTS

| | | | |
|---|---|---|---|
| D. 192,536 | 4/1962 | Laudano | D58/5 |
| D. 193,216 | 7/1962 | Laudano | D58/5 |
| D. 193,312 | 7/1962 | Buckley | D58/25 |
| D. 196,990 | 11/1963 | Dubbs | D58/25 |
| D. 198,404 | 6/1964 | Busch | D58/5 |
| D. 202,002 | 8/1965 | Douglas | D58/7 |
| D. 213,421 | 3/1969 | Leary | D9/101 |
| D. 214,550 | 7/1969 | Plummer | D9/44 |
| D. 272,321 | 1/1984 | Kretz | D9/1 |
| D. 275,556 | 9/1984 | Thomson | D9/389 |
| D. 278,977 | 5/1985 | Franchi et al. | D9/383 |
| D. 279,167 | 6/1985 | Haney et al. | D9/378 |
| D. 281,577 | 12/1985 | Larson et al. | D9/367 |
| D. 305,980 | 2/1990 | Binder et al. | D9/372 |
| D. 318,798 | 8/1991 | Biesecker | D9/378 |
| D. 323,983 | 2/1992 | Bastidos | D9/378 |
| D. 329,817 | 9/1992 | Best | D9/556 |
| D. 354,685 | 1/1995 | Kirshnakumar et al. | D9/543 |
| 4,610,366 | 9/1986 | Estes et al. | 220/675 X |
| 4,890,752 | 1/1990 | Ota et al. | 215/1 C |
| 4,993,565 | 2/1991 | Ota et al. | 215/1 C |
| 5,056,674 | 10/1991 | Swartley | 215/382 |
| 5,067,622 | 11/1991 | Garver et al. | 220/675 X |
| 5,141,121 | 8/1992 | Brown et al. | 215/100 A |
| 5,199,587 | 4/1993 | Ota et al. | 215/1 C |
| 5,224,614 | 7/1993 | Bono et al. | 216/398 X |
| 5,226,550 | 7/1993 | Kolaitis et al. | 215/100 A X |
| 5,392,937 | 2/1995 | Prevot et al. | 215/396 |

OTHER PUBLICATIONS

Mott's® Apple Juice Product Specification—Mar. 1992.
Tropicana Twister Light bottle.
Pocono Springs water bottle.
glass Mott's Apple Juice bottle.

*Primary Examiner*—Christopher T. McDonald
*Attorney, Agent, or Firm*—Pennie & Edmonds LLP

[57] ABSTRACT

A plastic bottle-shaped container comprises a top portion and a bottom portion. The top portion includes a neck area having a neck wall extending toward and then away from the center of the container when proceeding along its length to form a neck grip to allow a user to grasp the container. The bottom portion, which extends from the top portion, has a front wall, a back wall and side walls. Each side wall of the bottom portion has a recess. The recesses of the side walls together define a side grip to allow the user to grasp the container at the side walls.

10 Claims, 3 Drawing Sheets

BOTTLE-SHAPED CONTAINER

This is a, continuation, of application Ser. No. 08/338,272, filed Nov. 14, 1994, now abandoned, which is a continuation of application Ser. No. 08/116,327, filed Sep. 3, 1993, now abandoned.

BACKGROUND OF THE INVENTION

This invention relates to a bottle-shaped container and, in particular, to a plastic bottle-shaped container having grips to improve the user's ability to grasp and grip the container while also improving the structural support of the walls of the container to applied external and internal pressures.

Plastic bottle-shaped containers have been extremely common over the years in the beverage and household products industry. Generally, these containers, which have included a variety of shapes and sizes, have been blow molded from a biaxially oriented synthetic resin such as, for example, polyethylene terephthalate resin. Blow molding of plastics allows the containers to be easily formed with increased elasticity thereby producing a container which is durable, lightweight, and inexpensive.

U.S. Pat. No. 4,890,752 to Ota et al. ("Ota et al.") discloses one example of a biaxial-orientation blow-molded bottle-shaped container. The container is integrally molded with a neck at the top of a cylindrical body and includes a side grip formed by a pair of recesses which are rectangularly shaped and located on the rear portion of each side wall of the container. At the centers of the recesses are flat surface portions with a plurality of anti-slip strips formed axially in parallel at predetermined intervals. Lateral grooves are aligned axially at predetermined intervals in parallel on the front of the container.

The side grip of the above plastic container allows the user to lift and handle the container. However, depending upon the fill of the container and the characteristics of the user, the side grip may not always be comfortable and easy to use. This may cause a user to grasp the container in areas not adapted for gripping which could result in the user losing control and dropping of the container. It could also result in damage to the container in the grasped area. The contents of the container could thus be spilled or even worse the container could burst or break.

It is, therefore, an object of the present invention to provide a container having a grip configuration which makes grasping and gripping of the container easier and more comfortable.

It is a further object of the present invention to provide a container having a grip configuration which promotes increased mechanical and buckling strength.

It is an additional object of the present invention to provide a container having a grip configuration which promotes increased resistance to internal or external pressure applied to different areas of the walls of the container.

SUMMARY OF THE INVENTION

In accordance with the principles of the present invention, the above and other objectives are realized in a bottle-shaped container which is adapted to include, in addition to a side grip, a neck grip having a predetermined configuration which allows easy gripping of the bottle at the bottle neck. The bottle-shaped container can thus be grasped at the neck as well as at the side, thereby accommodating the tastes of different users as well as different fill conditions which may dictate selection of either one or the other of the grips.

The bottle-shaped container includes a top portion having a neck area with a neck wall extending toward and then away from the center of the container when proceeding along its length to thereby define the neck grip. The bottle-shaped container also includes a bottom portion having a front wall, a back wall and side walls. Each side wall has a recess with the recesses of the side walls together defining the side grip.

In the illustrative form of the invention disclosed hereinafter, the neck wall includes a plurality of longitudinally extending ridges spaced about the circumference of the wall to aid the user in grasping the neck grip. Each recess in each side wall, in turn, includes a first portion extending toward the center of the container and a second portion extending laterally from the first portion to the back wall. Each second portion of each recess has a plurality of parallel ridges which also act as an aid to the user when grasping the side grip. The front and back walls of the bottom portion each have a plurality of longitudinally spaced grooves extending substantially across the respective wall to provide additional mechanical strength for the walls of the container.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 2:
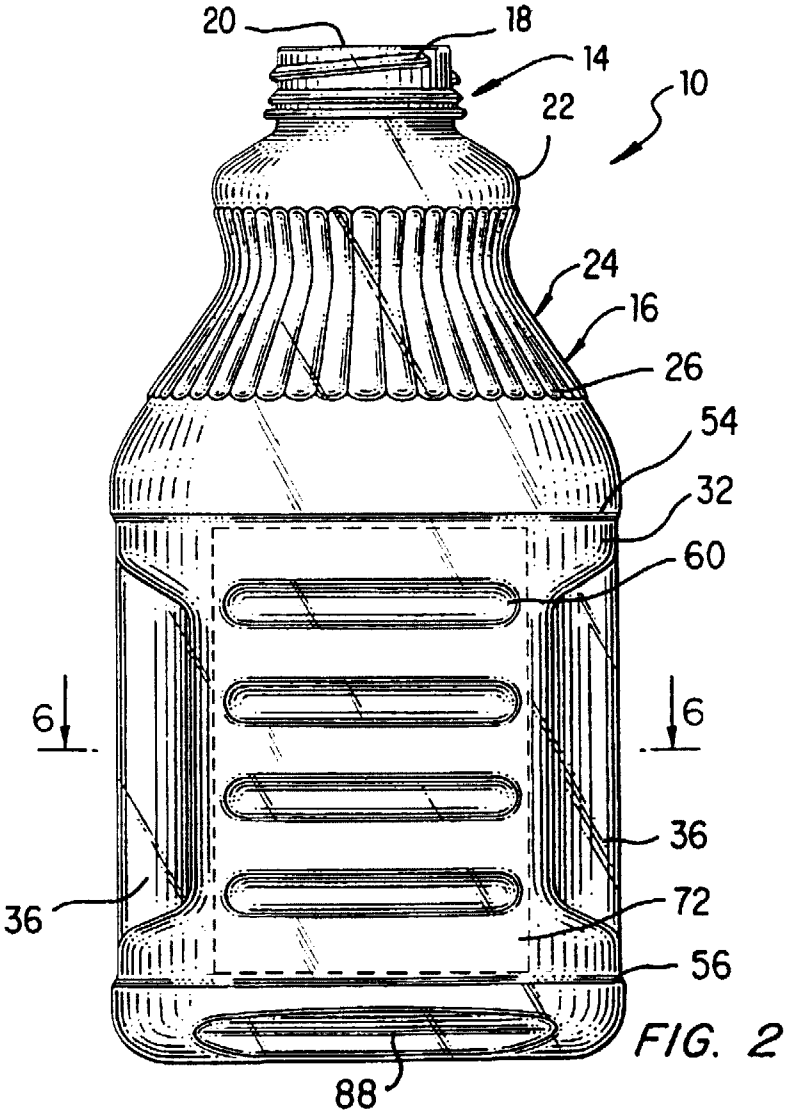
FIG. 2 shows a back view of the bottle-shaped container of FIG. 1.
Figure 1:
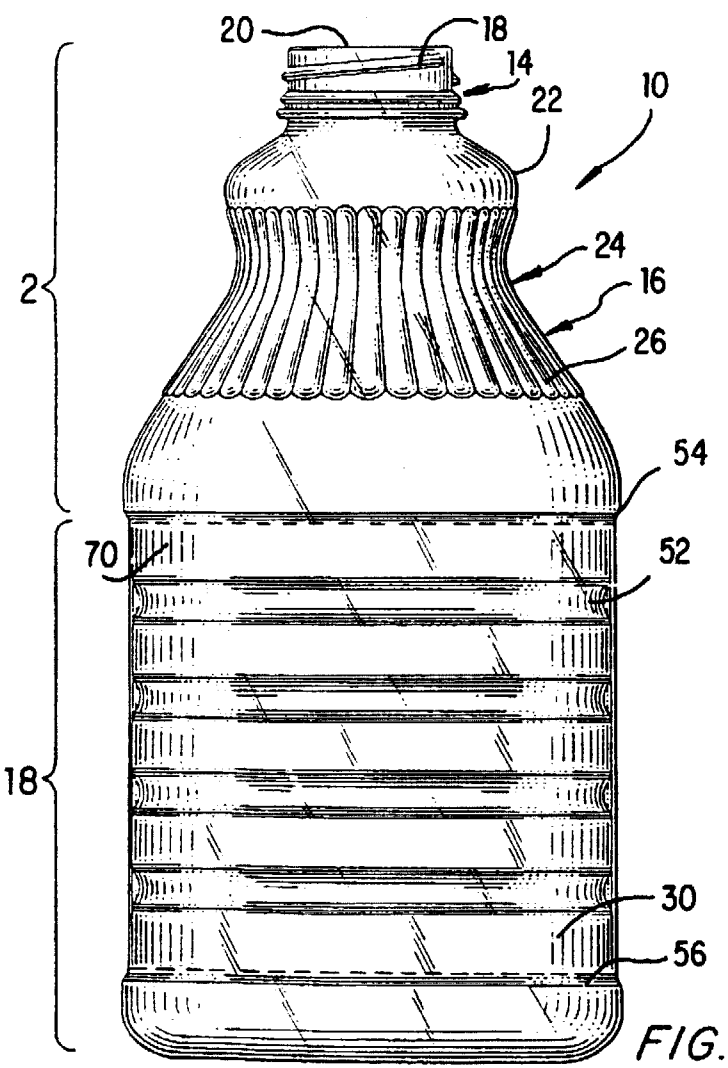
FIG. 1 shows a frontal view of a bottle-shaped container in accordance with the principles of the present invention.
Figures 3, 4, 5:
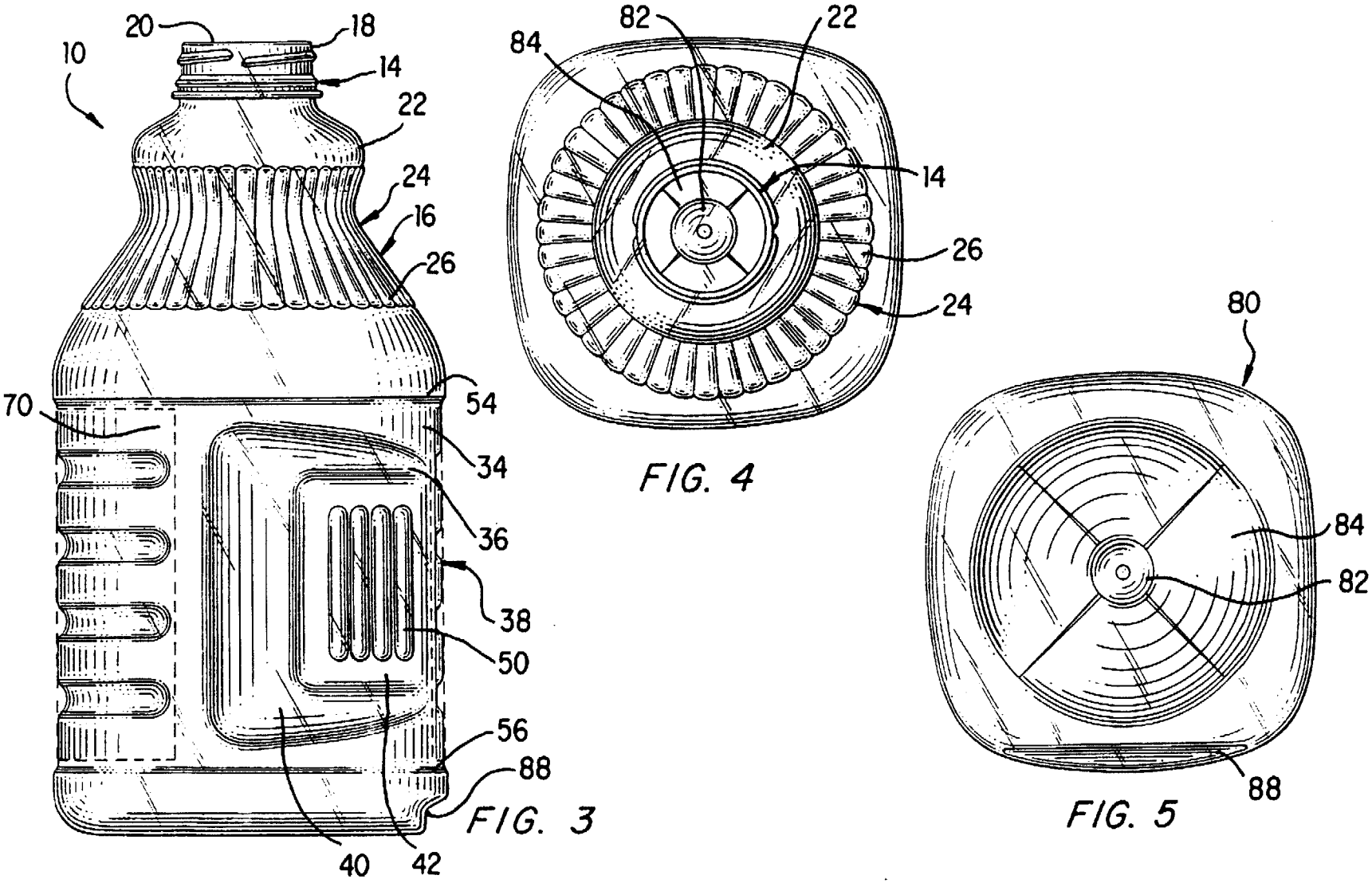
FIG. 3 shows a side view of the bottle-shaped container of FIG. 1.
FIG. 4 shows a top view of the bottle-shaped container of FIG. 1.
FIG. 5 shows a bottom view of the bottle-shaped container of FIG. 1.

FIGS. 1–3 show a bottle-shaped container 10 in accordance with the principles of the invention. As shown, bottle-shaped container 10 is plastic and comprises a top portion 12 which includes a cap portion 14 and a curved neck area 16. The cap portion 14 has a threaded area 18 for threaded engagement with a cap (not shown) to cover a circular opening 20. Extending downward from the cap portion 14 is the curved neck area 16.

In accord with the invention, the curved neck area 16 is defined by a neck wall 22 which, in the case shown, extends from the cap portion 14 away from the center of the container 10. The neck wall 22 then extends toward and then away from the center of the container 10 when proceeding along the length of the container. This defines a neck grip 24 of predetermined configuration which allows a user to easily grasp the container 10 at the neck area 16.

The neck wall 22 at the neck grip 24 also has a plurality of longitudinally extending ridges 26 which are equally spaced and encircle the circumference of the neck area 16. Each ridge 26 extends downward along a substantial portion of the neck area 16 as shown in FIGS. 1–3 and 4. The ridges 26 aid the user in grasping the neck grip 24 whose curved configuration already makes grasping of the container easy. The neck grip 24, in addition to or as an alternate for, the ridges 26 may include grooves, dots, geometrical shapes, diagonal lines, etc., to aid or provide resistance for the user's hand when grasping the container 10 and to help in redistributing the internal and external pressures applied to the container.

When the user grasps the neck grip 24 of the container 10, the thumb and the index finger of the user are positioned along the tops of the ridges 26 while the rest of the user's hand encircles and grasps the neck grip 24. The neck grip 24 thus allows for easy grasping, holding and maneuvering of the container. In addition, the curvature and ridges of the neck grip 24 provide mechanical strength for the walls of the container 10 if the container is dropped or when the container is grasped by redistributing the external and internal pressures applied to the container.

Below the neck area 16 of the top portion 12, the container 10 continues down to further define a bottom portion 28. The bottom portion 28 includes a front wall 30, a back wall 32 and side walls 34. (see FIGS. 1, 2 and 3, respectively).

The side walls 34 of the container 10 as shown in FIG. 3 are each provided with a recess 36. The recesses of the side walls together define a side grip 38. The side grip 38 also allows for easy grasping, holding and maneuvering of the container 10 from the side walls 34. The recesses 36 are oppositely positioned, symmetrical and traverse a substantial portion of each side wall. This configuration for the recesses allows for ready hand placement.

As shown, each recess 36 includes a first portion 40 extending toward the center of the container 10 followed by a second portion 42 extending laterally to the back wall 32. Each first portion 40 is planar and inclines from the respective side wall toward the center of the container 10 at an angle from the plane of the respective side wall. Each second portion 42 extends to the back wall 32 in somewhat aligned relationship with the plane of the respective side wall and includes a plurality of parallel ridges 50. The ridges 50 provide resistance for the user's hand to prevent slippage when grasping and gripping the container 10.

Figure 6:
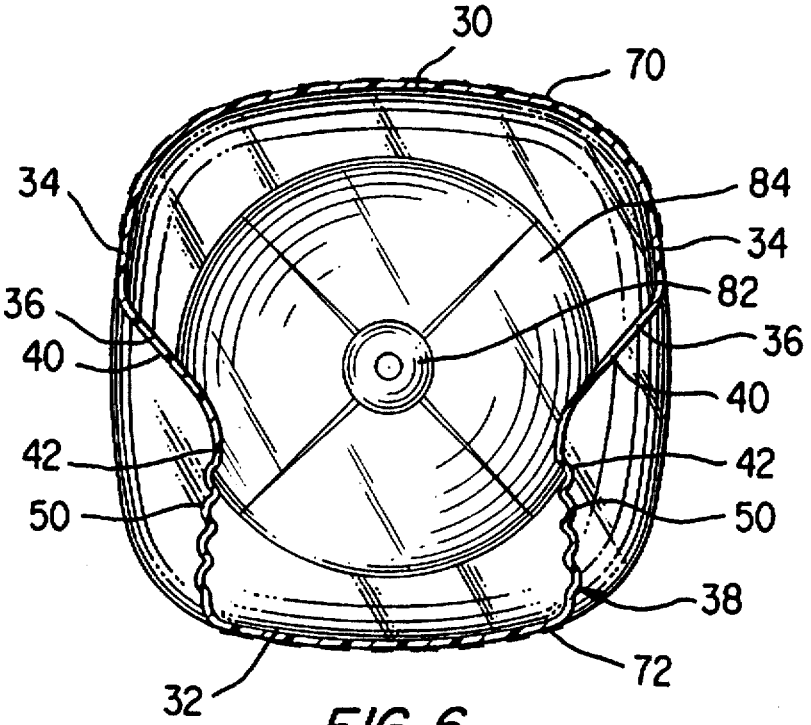
FIG. 6 shows a cross-sectional view taken along the line 6—6 in FIG. 2.

The aforesaid configuration of the recesses 36 is shown more clearly in FIG. 6 which is a cross-sectional view of the container 10. This Figure shows the incline of each first portion 40 and the ridges 50 of each second portion 42. The ridges 50 may be supplemented or replaced by grooves, dots, geometrical shapes, etc., to provide the desired gripping aid for the side grip 38 of the container 10.

As shown in FIG. 1, the front wall 30 of the container 10 includes a plurality of longitudinally spaced lateral grooves 52 which are equally spaced from each other. These grooves 52 traverse the entire front wall 30 and extend partially into each side wall 34 of the container 10. The grooves 52 are positioned between parallel borderlines 54 and 56 which encircle the circumference of the container 10. The grooves 52 and the borderlines 54 and 56 increase the rigidity and buckling strength of the container's walls when the container 10 is grasped or if the container 10 is dropped.

The front wall 30 may also have other means such as ridges which may be concave, convex or linear in shape to provide additional strength or resistance to buckling or deformation when the container 10 is dropped or grasped. The grooves 52 may also extend longitudinally rather than laterally along the front wall 30.

The back wall 32, as shown in FIG. 2, also comprises a plurality of longitudinally spaced lateral grooves 60 extending substantially across the back wall 32 of the container 10. The grooves 60 on the back wall 32, similar to the grooves 52 on the front wall 30, provide mechanical strength sufficient to withstand the forces applied to the side grip 38 by the user as well as deformation forces from dropping. Like the front grooves 52, the back grooves 60 may also incorporate a variety of shapes and forms.

Labels to indicate the product and the product information or description are affixed to the front wall 30 and the back wall 32, respectively, of the container 10, as shown in FIGS. 1–3 by dotted lines. FIGS. 1 and 3 show a large front label 70 covering the front wall 30 and extending vertically between borderlines 54 and 56 and partially onto the side walls 34. FIG. 2 shows a smaller back label 72 also extending vertically between the borderlines 54 and 56 and horizontally between each recess 36.

The labels 70 and 72 cover the front and back grooves 52 and 60, respectively. The grooves provide contouring to allow the labels 70 and 72 to remain affixed to the respective walls of the container 10. The positioning of the labels is not limited to the designated areas shown by the dotted lines in the Figures but may be affixed on any surface of the container 10 and may also be any size which is appropriate. Information may also be printed directly onto the container 10.

The container 10 may be grasped by gripping the side grip 38 by placing the user's fingers in both recesses 36 on the parallel ridges 50 and depressing inwardly on the second portions 42 of the recesses 36. Because of the configuration of the side grip 38, the user may easily grasp the container 10 with a thumb in one recess and a second finger in the other as well as with four fingers in one recess and the thumb in the other. Further, even if internal or external pressure is applied on the recesses 36, the pressure applied is transferred across the back grooves 60 on the back wall 32. Accordingly, the recesses 36 do not bend or deform as a result of the internal pressure from a liquid or other content placed in the container 10 and do not deform as a result of external pressure applied by the user grasping the container.

FIG. 5 shows a bottom view of the container 10. The container 10 has a square bottom 80 with a first concentric concave circular region 82 within a second concentric concave circular region 84 to assist in stabilizing the container 10 and prevent tipping, slippage or spillage.

The container 10 further has an oblong-shaped notch 88 as shown in FIG. 3 which traverses the bottom area of the back wall 32 of the container 10 and is positioned below the back grooves 60 of the back wall 32. The notch 88 positions and properly aligns the container 10 on a conveyer belt during production so that each container on the conveyor belt is positioned in the same direction to allow for liquid to be poured into the designated container during filling of the container.

The use of the neck grip 24 and the side grip 38 in the container 10 allows the container to be easily and comfortably handled and maneuvered in a stable manner by different users based upon individual likes and dislikes as to the grasping position of the user and based upon the fill of the liquid or other contents in the container. Thus, for example, when the container 10 is full, a particular user might select the side grip 38 so that user can more easily control the container 10 for moving the container and pouring from the container 10. As the container 10 empties, the particular user might then select the neck grip 24 for grasping the container, since the user might now find that control over the container for moving and pouring from the container is easier with this grip. Alternatively, another user might find the reverse procedure more comfortable, i.e., using the neck grip 24 when the container is full and then the side grip 38 when the container becomes more empty.

Additionally, if the container 10 is filled with liquid and is accidentally dropped, the structure of ridges, grooves and recesses helps to increase the mechanical strength of the walls of the container and to redistribute the internal and external pressures being applied to the walls of the container at impact to help prevent breakage and decrease deformation.

In all cases, it is understood that the above-described configuration is merely illustrative of the many possible specific embodiments which represent applications of the present invention. Numerous and varied other configurations, can be readily devised in accordance with the principles of the present invention without departing from the spirit and scope of the invention.

What is claimed is:

1. A bottle-shaped container comprising:

A top portion including a cap portion and a neck area having a neck wall extending from said cap portion away from the center of the container and then toward and then away from the center of the container when proceeding along the length of the container to form a neck grip, and dimensioned to allow a user to grasp said container at the neck area; and a bottom portion extending from said top portion, said bottom portion having a front wall, a back wall and side walls, each side wall of said bottom portion having a recess, said recesses of said side walls together defining a side grip to allow the user to grasp said container from said side walls.

2. A bottle-shaped container according to claim 1, wherein:

said bottle-shaped container is formed of plastic.

3. A bottle shaped container according to claim 1, wherein:

each said recess includes a first portion extending toward the center of the container followed by a second portion extending laterally to said back wall.

4. A bottle-shaped container according to claim 3, wherein:

each said second portion of each said recess includes a plurality of parallel ridges.

5. A bottle-shaped container according to claim 1, wherein: said neck wall has a plurality of longitudinally extending ridges spaced about the circumference of said neck area to enhance grasping by the user of said neck grip of said container.

6. A bottle-shaped container according to claim 1, wherein: said front wall has a plurality of longitudinally spaced lateral grooves extending substantially across the front wall of said container.

7. A bottle-shaped container according to claim 1, wherein: said back wall has a plurality of longitudinally spaced lateral grooves extending substantially across the back wall of said container.

8. A bottle-shaped container according to claim 1, wherein: said recesses of said side walls are oppositely positioned from each other.

9. A bottle-shaped container according to claim 1, wherein: said recesses of said side walls are symmetrically positioned.

10. A bottle-shaped container comprising:

A top portion including a neck area having a neck wall extending toward and then away from the center of the container when proceeding along the length of the container, and said neck wall having a plurality of longitudinally extending ridges spaced about the circumference of said neck area to form a neck grip to allow a user to grasp said container at the neck area; and a bottom portion extending from said top portion, said bottom portion having a front wall, a back wall and side walls, each side wall of said bottom portion having a recess, said recesses of said side walls together defining a side grip to allow the user to grasp said container from said side walls.

* * * * *